United States Patent [19]

Amstutz et al.

[11] Patent Number: 4,629,076

[45] Date of Patent: Dec. 16, 1986

[54] SLATBOARD

[75] Inventors: Douglas D. Amstutz; Donald D. Kelemen, both of Muskegon, Mich.

[73] Assignee: Amstore Corporation, Muskegon, Mich.

[21] Appl. No.: 840,025

[22] Filed: Mar. 17, 1986

Related U.S. Application Data

[62] Division of Ser. No. 608,872, May 10, 1984, Pat. No. 4,591,051.

[51] Int. Cl.[4] ..... A47F 5/08

[52] U.S. Cl. ..... 211/94; 156/64; 211/87; 248/220.2

[58] Field of Search ..... 211/87, 94, 189; 52/588, 36, 38, 282, 710, 711; 248/220.3, 220.2, 221.2, 222.2; 40/16, 10 R, 16.2; 156/64

[56] References Cited

U.S. PATENT DOCUMENTS

| | | | |
|---|---|---|---|
| 382,143 | 5/1888 | Curzon | 40/618 X |
| 516,301 | 3/1894 | Douglass | 40/585 |
| 1,149,082 | 8/1915 | Rand | 40/620 |
| 1,887,591 | 11/1932 | Inqita | 40/618 |
| 2,101,965 | 12/1937 | Trees | 40/611 |
| 2,272,733 | 2/1942 | Wamser | 40/576 |
| 2,514,046 | 7/1950 | Gerbes | 40/162 |
| 2,548,657 | 4/1951 | Dunn | 40/16 X |
| 2,607,144 | 8/1952 | Harris | 40/576 |
| 2,745,201 | 5/1956 | Giuseppe et al. | 40/618 |
| 2,995,849 | 8/1961 | Donnellan | 40/611 X |
| 3,235,218 | 2/1966 | Graham | 248/220.3 |
| 3,337,977 | 8/1967 | Sobesky | 40/10 |
| 3,352,428 | 11/1967 | Sak et al. | 211/87 |
| 3,535,807 | 10/1970 | Baldwin | 40/140 |
| 3,652,048 | 3/1972 | Hartman | 211/90 X |
| 4,184,277 | 1/1980 | Larin | 40/10 R |
| 4,211,379 | 7/1980 | Morgan et al. | 248/243 X |
| 4,219,952 | 9/1980 | Flath | 40/611 X |
| 4,275,516 | 6/1981 | Lane | 40/107 |
| 4,323,163 | 4/1982 | Johns | 211/189 |
| 4,331,491 | 5/1982 | Shaw et al. | 156/64 |
| 4,367,604 | 1/1983 | Porter, II et al. | 40/564 |
| 4,391,662 | 7/1983 | Mauthe | 156/64 |
| 4,434,900 | 3/1984 | Cook | 211/189 |
| 4,450,655 | 5/1984 | Rosenthall et al. | 52/36 |

*Primary Examiner*—Robert W. Gibson, Jr.

*Attorney, Agent, or Firm*—Price, Heneveld, Huizenga & Cooper

[57] ABSTRACT

The specification discloses a sandwiched reinforced slatboard assembly including a baseboard, a plurality of C-shaped reinforcing channels arranged on the baseboard, and a plurality of T-shaped slats secured to the baseboard to entrap the channels therebetween. Optionally, the C-shaped channels are omitted and the slats are secured to the baseboard using a colored adhesive which is visible between the slats to provide a decorative appearance. Also disclosed is a modified assembly wherein decor strips are removably received within the slots, and wherein the slots are configured to retain the strips against the back wall of the slot.

4 Claims, 5 Drawing Figures

SLATBOARD

This is a division of application Ser. No. 608,872, filed May 10, 1984, now U.S. Pat. No. 4,591,051.

BACKGROUND OF THE INVENTION

The present invention relates to merchandising displays, and more particularly to slatboards.

A wide variety of slatboard, or slatwall, constructions have been developed as merchandising displays. Typically, the boards include parallel slots, or channels, into which hardware can be releasably inserted to support shelves or merchandise. Those boards including T-shaped or L-shaped slots are generally referred to as "slatboard" or "slotboard" while those boards including slots inclined 45° downwardly from the face of the board are generally referred to as "groove wall". Groove wall supports only "groove wall" hardware; while slatboard with T-shaped slots supports both "groove wall" and "slatboard" hardware.

Often, the slots or channels in slatboard are routed into the board using conventional routing techniques—a relatively slow process. The formation of the slots leaves relatively thin, and therefore weak, board portions. If the load imposed on the hardware is excessive, the hardware will fracture these fragile board portions and pull out of the board. Known boards therefore have drawbacks. A display may injure someone if it falls from the board. Further, the slatboard is ruined at the fracture, and typically the only visually acceptable correction is to replace the entire slatboard.

In an attempt to alleviate the problems associated with the fragility of slatboards, one prior artisan has developed a reinforced slatboard including a metal insert within each slot in the board. This slatboard is sold under the mark SPACEWALL by Spacewall, Inc., of Stone Mountain, Ga. The board includes a plurality of L-shaped slots and a reinforcing insert within each slot closely conforming to the cross-sectional shape of the slot. Each reinforcing insert includes a pair of edges exposed at the slot opening to be visible at the front face of the slatwall. This construction also has drawbacks. First, the reinforcing insert edges are visible in the assembled slatwall, providing a somewhat undesirable aesthetic effect. Second, the L-shaped slots restrict the type of available hardware which can be used therewith.

SUMMARY OF THE INVENTION

The aforementioned problems are overcome by the present invention comprising a reinforced slatwall adapted to support a wide variety of hardware thereon. In a first aspect of the invention, the slatwall includes a slatboard defining a T-shaped slot, and a C-shaped reinforcing insert positioned within the slot to reinforce the thin portions of the board. The open side or mouth of the slot is narrower than the open side or mouth of the insert so that the edges of the insert are not readily visible in the slatboard. Consequently, the visual uniformity of the slatboard face is broken only by the slots. Further, the T-shape of the slot adapts the slatboard to receive a wide variety of suspension hardware including both "groove wall" and "slatboard" hardware.

In a preferred aspect of the invention, the slatboard further comprises a generally planar baseboard and a plurality of T-shaped slats secured thereto generally parallel one another to define the T-shaped slots. The C-shpaed inserts are entrapped between the baseboard and slats during installation of the slats. This construction eliminates the necessity of routing slots into the slatboard.

In another aspect of the invention, the slatboard comprises a generally planar baseboard, and a plurality of slats secured to the baseboard to define the slots therewith. A colored adhesive is uniformly applied over the surface of the baseboard to secure the slats thereto. Because the adhesive is visible between the slats on the slatboard, the adhesive color contributes to the desired aesthetic appearance of the slatboard. This enable the manufacturer to produce visually different slatboards using a common construction and varying the color of the adhesive. For example, the adhesive color can be selected to match or contrast with the face of the slats.

In a further aspect of the invention, the slatboard assembly includes a slatboard defining a plurality of generally parallel slots, a plurality of decorative strips one each positioned within each of the slots, and structure for maintaining each decorative strip against the back of its associated slot. This construction enables the appearance of the slatboard to be readily changed simply by replacing the decorative strips within the slots. The structure maintaining the decorative strips against the back wall of the slots insures that the strips will be positively maintained in a desired position.

These and other objects, advantages, and features of the invention will be more readily understood and appreciated by reference to the detailed description of the preferred embodiments and the drawings.

DETAILED DESCRIPTION OF THE PREFERRED EMBODIMENTS

First Embodiment

Figure 1:
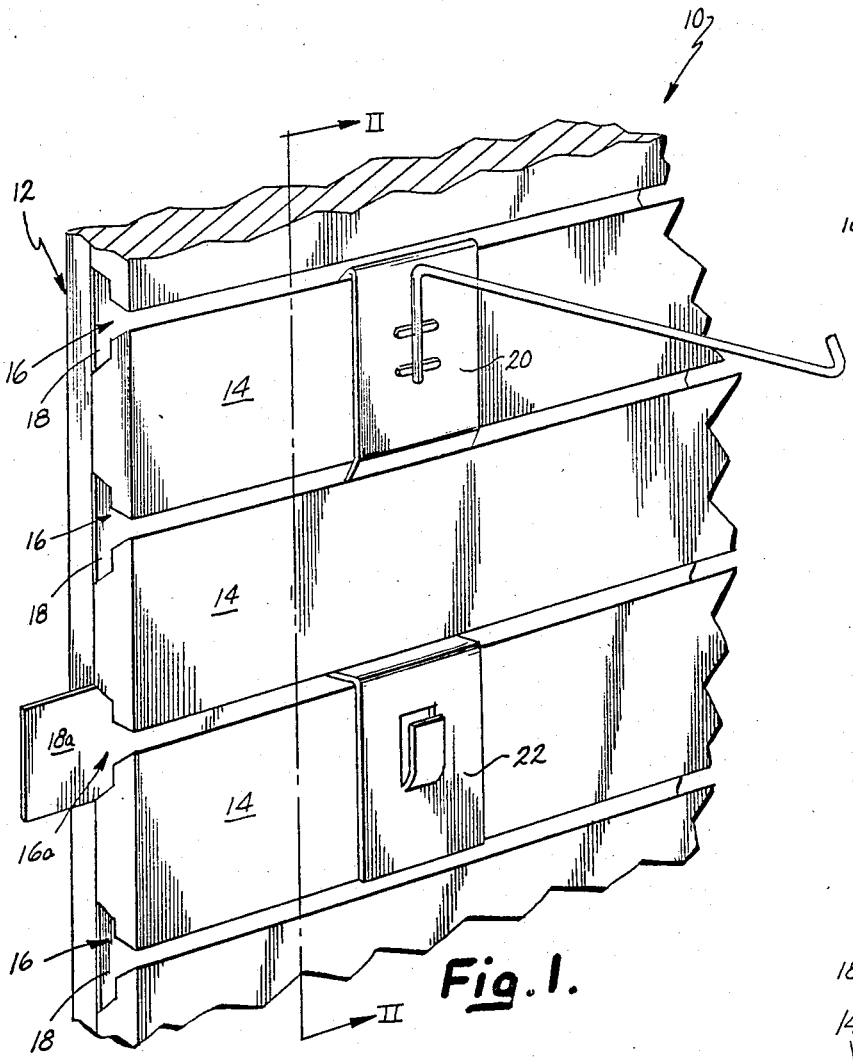
FIG. 1 is a fragmentary perspective view of the slatboard of the present invention with two hardware hangers mounted thereon.
Figure 2:
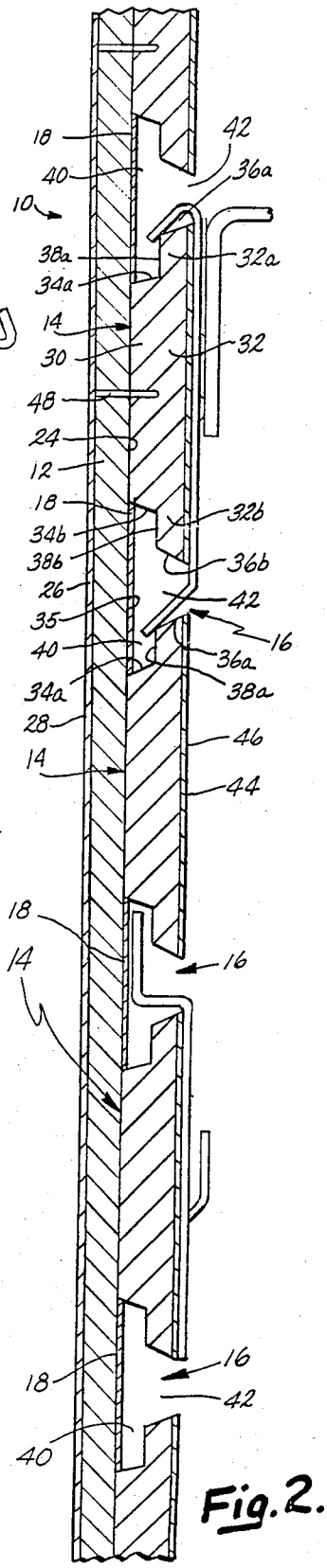
FIG. 2 is a fragmentary sectional view taken along plane II—II in FIG. 1.

A first slatboard constructed in accordance with one of the preferred embodiments of the invention is illustrated in FIGS. 1 and 2 and generally designated 10. The slatboard generally comprises baseboard 12, a plurality of T-shaped slats 14 secured to the baseboard to define T-shaped slots 16, and decor strips 18 positioned within each of the slots. The T-shaped cross section of slots 16 enables both "groove wall" hardware, such as hanger 20, or "traditional slatboard" hardware, such as hanger 22, to be suspended therefrom. Because decor strips 18 are removably slidable within slots 16, the appearance of the slatboard can be altered by replacing the decor strips with other decor strips having a desired appearance.

Baseboard 12 (FIGS. 1 and 2) is a generally planar member and in the preferred embodiment comprises medium density fiberboard (MDF) such as that manufactured by Plum Creek. Alternatively, baseboard 12 could be particle board. Baseboard 12 includes forward face 24 and rear face 26. If rear face 26 is to be exposed in the merchandising display, plastic laminate 28 is adhesively secured thereto to provide a desired appearance.

Slats 14 (FIGS. 1 and 2) are generally T-shaped in cross section and are preferably also fabricated of MDF. Each slat includes stem portion 30 adhesively secured to baseboard 12 and crossbar portion 32 including overhangs 32*a* and *b*. Stem 30 defines a pair of opposite beveled walls 34*a* and *b* which are angled away from one another as they extend away from baseboard 12. Each wall 34*a* defines the lower wall of a slot 16, while each wall 34*b* defines the upper wall of a slot 16. Consequently, the upper and lower walls 34*b* and a of each slot 16 extend toward one another and away from baseboard 12 to define a portion of a V. The portion of baseboard face 24 between each pair of upper and lower walls 34 defines rear wall 35 of slot 16.

Overhangs 32a and b (FIG. 2) of crossbar portion 32 terminate in beveled ends 36*a* and *b*, respectively, which define a portion of a V. Opposing ends 36 of adjacent slats 14 define mouth 42 of slot 16. Overhang walls 38*a* and *b* extend between walls 34 and ends 36 and are generally parallel to baseboard 12. Consequently, each of slots 16 is generally T-shaped including crossbar portion 40 and mouth portion 42. Front faces 44 of slats 14 are finished to provide a desired appearance. For example, plastic laminate 46 can be adhered to front surface 44 to provide a visually attractive and protective finish. In the preferred embodiment, the distance between rear wall 35 and overhang walls 38 is one-fourth inch, and the distance between the face of laminate 46 and walls 38 is also one-fourth inch.

Decor strips 18 (FIGS. 1 and 2) are slidably received within slots 16. Strip 18*a* (FIG. 1) is shown partially withdrawn from its associated slot 16*a*. Strips 18 have a generally uniform height which is substantially the same as the distance between upper and lower walls 34*b* and a at rear wall 35. Walls 34 therefore cooperate to provide a means for maintaining decor strip 18 proximate or adjacent rear wall 35. Consequently, decor strip 18 cannot flip-flop or fall forward in slot 16. Preferably, decor strips 18 are fabricated of polyvinyl chloride. Of course, a wide variety of materials can be substituted to provide a desired appearance to strips 18 and slatboard 10.

Second Embodiment

Figure 3:
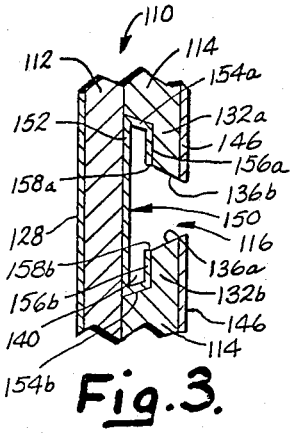
FIG. 3 is a fragmentary, sectional view similar to FIG. 2 of an alternative embodiment of the invention.

A second embodiment of the invention is illustrated in FIG. 3 and generally designated 110. This slatboard includes baseboard 112, a plurality of slats 114 secured thereto, and a C-shaped reinforcing insert 150 positioned within each of slots 116. Baseboard 112, slats 114, slots 116, and laminates 128 and 146 are substantially identical to those described in conjunction with slatboard 10. Consequently, their detailed construction will not be repeated here.

C-shaped inserts 150 are preferably roll-formed of 24-gauge cold-rolled steel stock. The inserts include rear wall 152, upper and lower walls 154*a* and *b* extending forwardly therefrom, and front walls 156*a* and *b* extending toward one another from upper and lower walls 154*a* and *b*, respectively. Walls 156*a* and *b* terminate in opposed edges 158*a* and *b*, respectively, which define the open side of insert 150. The distance between opposed edges 158 is substantially the same as the largest distance between beveled ends 136 and consequently less than the smallest distance between the beveled ends. Edges 158*a* and *b* are therefore not readily visible within slot 116. The cross-sectional shape of insert 150 conforms closely to crossbar portion 140 of slot 116. Insert 150 provides reinforcement to statboard assembly 110 so that hardware supported within the slatboard can bear relatively heavy forces without breaking fragile extensions 132. This greatly improves the safety and load-bearing capabilities of the resultant assembly. Preferably, insert 150 is finished prior to rolling to provide a desired visual effect through slot 16.

Third Embodiment

Figure 4:
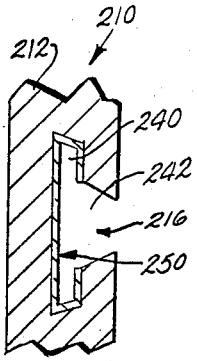
FIG. 4 is a fragmentary sectional view similar to FIG. 2 showing another alternative embodiment of the invention.

A third embodiment of the invention is illustrated in FIG. 4 and generally designated 210. This embodiment includes slatboard 212 which is routed using conventional techniques to form slot 216. The width of board 212 is substantially the same as the combined width of baseboard 12 and slats 14 in embodiment 10. The configuration of slot 216 is generally identical to the configuration of slot 16. C-shaped insert 250, generally identical to insert 150 of embodiment 110, is positioned within slot 216. Consequently, embodiment 210 of FIG. 4 is generally identical to embodiment 110 of FIG. 3 with the exception that a single board 212 is substituted for the baseboard 112 and slats 114 of the previous embodiment. Consequently, assembly 210 possesses the safety and strength characteristics of assembly 110.

Fourth Embodiment

Figure 5:
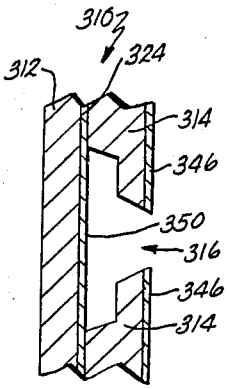
FIG. 5 is a fragmentary sectional view similar to FIG. 2 showing yet another alternative embodiment of the invention.

A fourth embodiment of the invention is illustrated in FIG. 5 and generally designated 310. This embodiment includes baseboard 312 and a plurality of slats 314 adhesively secured thereto. Baseboard 312 and slats 314 are generally identical to their counterparts in embodiment 10 previously described and consequently will not be redescribed in detail. Colored adhesive or glue 350 is applied to front face 324 of baseboard 312 in a desired pattern and preferably overlies the entire baseboard in an even coat. In the preferred embodiment, adhesive 350 is the polyvinyl adhesive sold by National Casing under desgination "4700". Adhesive is visible within slots 316 and therefore contributes to the aesthetic appeal or visual effect of resultant assembly 310. Laminate or melimine 346 is applied to slats 314 to provide the slats with a desired finish. The color of adhesive 350 and the color of laminate 346 are selected to provide a desired visual effect, for example matching colors, contrasting colors, or complimentary colors.

Assembly

Slats 14 of slatboard 10 are fabricated by adhesively securing laminate 46 to front face 44 of each slat and routing the slat to form walls 34, ends 36, and overhang walls 38*a*. Slats 14 are arranged on baseboard 12 generally parallel to one another in side-by-side fashion to define slots 16 therebetween. Slats 14 are adhesively secured to baseboard 12. Optionally, staples 48 are inserted through baseboard 12 and into slats 14 to further secure the baseboard and slats together. The decor strips are slid into each slot as indicated in FIG. 1. The color of the decor strips is selected to provide a desired visual effect in combination with plastic laminate 46. The T-shaped configuration of slots 16 enables board 10 to receive both standard groove wall brackets 20 and slatwall brackets 22. Additionally, slatwall 10 can be installed either right side up or upside down because slots 16 are symmetrical. Any time that a variation in the appearance of the assembly 10 is desired, decor strips 18 are removed and replaced with decor strips having other desired visual characteristics. The configuration of slots 16 is such that each of decor strips 18 is maintained against or proximate rear wall 35 of the slot.

Assembly 110 (FIG. 3) is assembled in a similar fashion to assembly 10 previously described. The only difference is that channel inserts 150 are arranged on baseboard 112 prior to the securement of slats 114 thereto. As slats 114 are secured to baseboard 112, inserts 150 are entrapped between the baseboard and the slats. Both brackets 20 and 22 pull outwardly on channel walls 156 and overhang portions 32; and the reinforcement provided by insert 150 substantially reduces the possibility that the slatwall will fracture under the load of the brackets. Consequently, the load-carrying capabilities and safety of the slatwall are greatly improved.

Alternative assembly 310 is also fabricated in a manner generally identical to that of assembly 10. Colored adhesvie 350 is applied to baseboard 312 in a selected manner to intersecure the baseboard and slats 314. In the preferred embodiment, adhesive 350 is applied as an even coat over the entire surface of baseboard 312. However, it is anticipated that the adhesive could be applied as parallel lines, stripes, or other patterns to provide a desired effect. The colored glue 350 visible within slot 316, together with plastic laminate 346 provides an aesthetically pleasing appearance to the slatboard assembly 310.

Assembly 210 is fabricated by first routing slots 216 in board 212. The slots are routed in a two-pass operation. The first pass forms mouth portion 242, while the second pass forms crossbar portion 240. C-shaped inserts are slid laterally into slots 216 and preferably extend the full length of the slot. The resultant assembly 210 has the strengthened structural advantages of assembly 110 previously described.

The above descriptions are those of preferred embodiments of the invention. Various changes and alterations can be made without departing from the spirit and broader aspects of the invention as set forth in the append claims, which are to be interpreted in accordance with the principles of patent law, including the doctrine of equivalents.

The embodiments of the invention in which an exclusive property or privilege is claimed are defined as follows:

1. A decorative slatboard assembly comprising;

a baseboard including a supportive side;

a colored adhesive overlying substantially the entire supporting side of said baseboard; and a plurality of elongated slats secured to said support side of said baseboard by means of said adhesive, said slats being arranged side-by-side to define a plurality of slots therebetween for receiving hanger hardware, said adhesive being visible between said slats to provide a desired decorative appearance.

2. A slatboard assembly as defined in claim 1 wherein said slats include an exposed finish providing a desired visual effect in combination with said colored adhesive.

3. A method of fabricating a slatboard assembly comprising:

applying a colored adhesive to substantially the entire supporting side of a baseboard; and positioning a plurality of elongated slats on the support side of the baseboard to be secured thereto by means of the adhesive, said positioning step including positioning the slats generally parallel one another in spaced relationship to define a plurality of slots therebetween for receiving hanger hardware, whereby the colored adhesive is visible between the slats to provide a desired decorative appearance.

4. A method as defined in claim 3 further comprising providing the slats with an exposed finish to provide a desired visual effect in combination with said colored adhesive.

* * * * *